US010918169B2

(12) United States Patent
Kolasa et al.

(10) Patent No.: US 10,918,169 B2
(45) Date of Patent: Feb. 16, 2021

(54) LOCKING POSITION ADJUSTMENT DEVICE

(71) Applicant: ILLINOIS TOOL WORKS INC., Glenview, IL (US)

(72) Inventors: Scott David Kolasa, Mount Prospect, IL (US); Steven Craig Keller, Island Lake, IL (US); Michael Wesley Havran, Seattle, WA (US); Eric William Millward, Evanston, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 16/256,674

(22) Filed: Jan. 24, 2019

(65) Prior Publication Data

US 2019/0269206 A1 Sep. 5, 2019

Related U.S. Application Data

(60) Provisional application No. 62/637,439, filed on Mar. 2, 2018.

(51) Int. Cl.

| | |
|---|---|
| ***A44B 11/12*** | (2006.01) |
| ***A44B 11/25*** | (2006.01) |
| ***A44B 11/00*** | (2006.01) |
| ***A45C 13/10*** | (2006.01) |
| ***A44B 99/00*** | (2010.01) |

(52) U.S. Cl.

CPC ..... *A44B 11/2592* (2013.01); *A44B 11/006* (2013.01); *A44B 11/12* (2013.01); *A44B 99/00* (2013.01); *A45C 13/1076* (2013.01)

(58) Field of Classification Search

CPC ..... A44B 11/2592; A44B 99/00; A44B 11/12; A44B 11/006

See application file for complete search history.

(56) References Cited

U.S. PATENT DOCUMENTS

| | | | | | |
|---|---|---|---|---|---|
| 1,004,542 | A | * | 9/1911 | Nearing | A44B 11/2596 24/698.2 |
| 1,355,997 | A | | 10/1920 | Morrison | |
| 1,361,647 | A | * | 12/1920 | Vaisset | A44B 11/12 24/170 |
| 2,224,773 | A | * | 12/1940 | Shaulson | A44B 11/28 24/200 |
| 2,981,993 | A | * | 5/1961 | Elsner | B60P 7/0823 24/170 |
| 3,066,374 | A | * | 12/1962 | Garson | A41F 15/002 24/198 |

(Continued)

FOREIGN PATENT DOCUMENTS

| | | | |
|---|---|---|---|
| EP | 2813447 | A1 | 12/2014 |
| JP | H08186385 | A | 7/1996 |
| JP | 2002348715 | A | 12/2002 |

OTHER PUBLICATIONS

European Search Report from European Application No. 19159638.6, dated Jun. 26, 2019.

*Primary Examiner* — Jason W San

(74) *Attorney, Agent, or Firm* — Quarles & Brady LLP

(57) ABSTRACT

A locking slide clip includes a C-shaped body and a door. The C-shaped body defines an opening in communication with a slot. The door is pivotably engaged with the C-shaped body opposite the slot and includes a protrusion.

18 Claims, 17 Drawing Sheets

(56) References Cited

U.S. PATENT DOCUMENTS 3,075,268 A * 1/1963 Schwartz ..... A41F 15/002 24/200
3,589,341 A * 6/1971 Krebs ..... A01K 27/005 119/865
4,458,390 A * 7/1984 Fogelson ..... A44B 11/006 24/182
4,726,625 A * 2/1988 Bougher ..... A44B 11/12 24/170
4,727,628 A * 3/1988 Rudholm ..... A44B 11/12 24/170
4,733,440 A * 3/1988 Ogawa ..... A44B 11/06 24/170
4,912,818 A * 4/1990 Meeker ..... B60R 22/30 24/17 B
5,161,351 A * 11/1992 Woodruff ..... A44B 11/14 24/170
5,291,638 A * 3/1994 Huang ..... A44B 11/14 24/170
5,465,472 A 11/1995 Matoba
6,081,973 A * 7/2000 Liu ..... A44B 11/24 24/170
6,098,859 A * 8/2000 Bortner ..... A44B 11/12 224/195
6,735,826 B2 * 5/2004 Uehara ..... A44B 11/12 24/170
6,868,585 B2 * 3/2005 Anthony ..... A44B 11/14 24/134 R
7,051,407 B2 * 5/2006 Hsu ..... A41F 15/002 2/323
7,444,720 B2 * 11/2008 Huang ..... A44B 11/12 24/170
7,478,459 B2 * 1/2009 Kawaguchi ..... A44B 11/12 24/170
7,506,418 B2 * 3/2009 Dingel ..... A44B 11/12 24/629
7,631,401 B2 * 12/2009 Chen ..... A44B 11/02 24/171
8,464,402 B2 * 6/2013 Mamie ..... B60P 7/0823 24/170
8,561,267 B2 * 10/2013 Chang ..... A44B 11/12 211/89.01
8,689,364 B2 * 4/2014 Rowland ..... A41F 9/025 2/311
8,732,915 B2 * 5/2014 Kolasa ..... A42B 3/08 24/170
8,763,210 B2 * 7/2014 Vincent ..... A43B 5/04 24/68 SK
8,764,360 B2 * 7/2014 Vick ..... A44B 11/04 410/97
D717,145 S * 11/2014 Tang ..... D8/34
8,935,833 B2 * 1/2015 Kaneko ..... A44B 11/065 24/170
9,125,458 B2 9/2015 Grimm et al.
9,149,090 B1 * 10/2015 Taylor ..... A41F 9/02
9,149,091 B2 * 10/2015 Ishii ..... A44B 11/12
9,301,578 B2 * 4/2016 Shinya ..... A44B 11/04
9,351,539 B2 * 5/2016 Briggs ..... A43C 11/146
9,591,895 B2 * 3/2017 Shirai ..... A44B 11/223
9,622,547 B2 * 4/2017 Seader ..... A44B 11/12
9,993,669 B2 * 6/2018 Casebolt ..... A62B 35/0037
10,299,545 B2 * 5/2019 Rowland ..... A44B 11/24
10,342,297 B2 * 7/2019 Fukui ..... A44B 11/12
10,433,619 B2 * 10/2019 Wong ..... A44B 11/12
10,786,048 B2 * 9/2020 Dee ..... A44B 11/12
2013/0185902 A1 7/2013 Hitoshi
2015/0135486 A1 * 5/2015 Fiedler ..... A44B 11/2584 24/303
2015/0296929 A1 * 10/2015 Kung ..... A44B 11/28 24/164
2015/0342306 A1 * 12/2015 Chen ..... A44B 11/006 24/185
2016/0166013 A1 * 6/2016 Szewczyk ..... A44B 11/125 297/468
2016/0174665 A1 * 6/2016 Kung ..... A44B 11/12 24/170
2019/0269206 A1 * 9/2019 Kolasa ..... A44B 99/00
2019/0387844 A1 * 12/2019 Millward ..... F16B 2/185

* cited by examiner

LOCKING POSITION ADJUSTMENT DEVICE

RELATED APPLICATION

This application claims the benefit of U.S. Provisional Application No. 62/637,439 filed on Mar. 2, 2018, which is hereby incorporated by reference in its entirety.

FIELD OF THE DISCLOSURE

This disclosure relates generally to strapping buckles and, more particularly, to a locking position adjustment device.

BACKGROUND

In recent years, buckles have been developed to securely connect components together. For example, various bags, backpacks, and the like have male and female buckle members connected to straps (including webbing, strings, and/or the like). Each strap, for example, is looped through a web-retaining channel on a buckle member. In order to connect the looped straps together, the male buckle member is connected to the female buckle member.

Certain known buckle components are configured to be secured to an article (e.g., backpacks, messenger bags, etc.). The article is equipped with a textile rail formed of relatively stiff piping (e.g., plastic string trimmer cord) wrapped in webbing. The known buckle components are sized to slidably clip around the piping and the webbing. An individual may slide the known buckle components to a position near his or her sternum when the article is carried by the individual.

However, these known buckle components are relatively long and may occupy an uncomfortable amount of space on the sternum of the individual. Further, if the known buckle components detaches from the piping, the known buckle components may be difficult to reattach to the article. Moreover, while the known buckle components may be adjustable with respect to the article, the known buckle components may undesirably shift in relation to the article.

Additionally, the known buckle components connection members may be susceptible to breaking. Further, manufacturing the known buckle components and compatible articles is complex and time-consuming because of the complex shapes of the known buckle components and the tightly wrapped textile rail.

Therefore, a need exists for a buckle component that is ergonomic and secures tightly to an article without a textile rail. Further, a need exists for a buckle component that may be manufactured more efficiently.

SUMMARY

In one aspect, a locking slide clip is disclosed, which includes a C-shaped body and a door. The C-shaped body defines an opening in communication with a slot. The door is pivotably engaged with the C-shaped body opposite the slot and comprises a protrusion.

In a different aspect, another locking slide clip is disclosed, which includes a body and a door. The body comprises a rectilinear upper portion, a first leg, and a second leg. The first and second legs extend below the upper portion. The door is pivotably engaged with the upper portion and comprises a protrusion.

In yet another aspect, another locking slide clip is disclosed, which includes a body and a door. The body defines a door cavity and a cam channel. The door is pivotably engaged with the body and comprises a first protrusion and a second protrusion. The first protrusion is at least partially disposed in the door cavity. The second protrusion extends from the first protrusion and is at least partially disposed in the cam channel.

DETAILED DESCRIPTION

Figure 1:
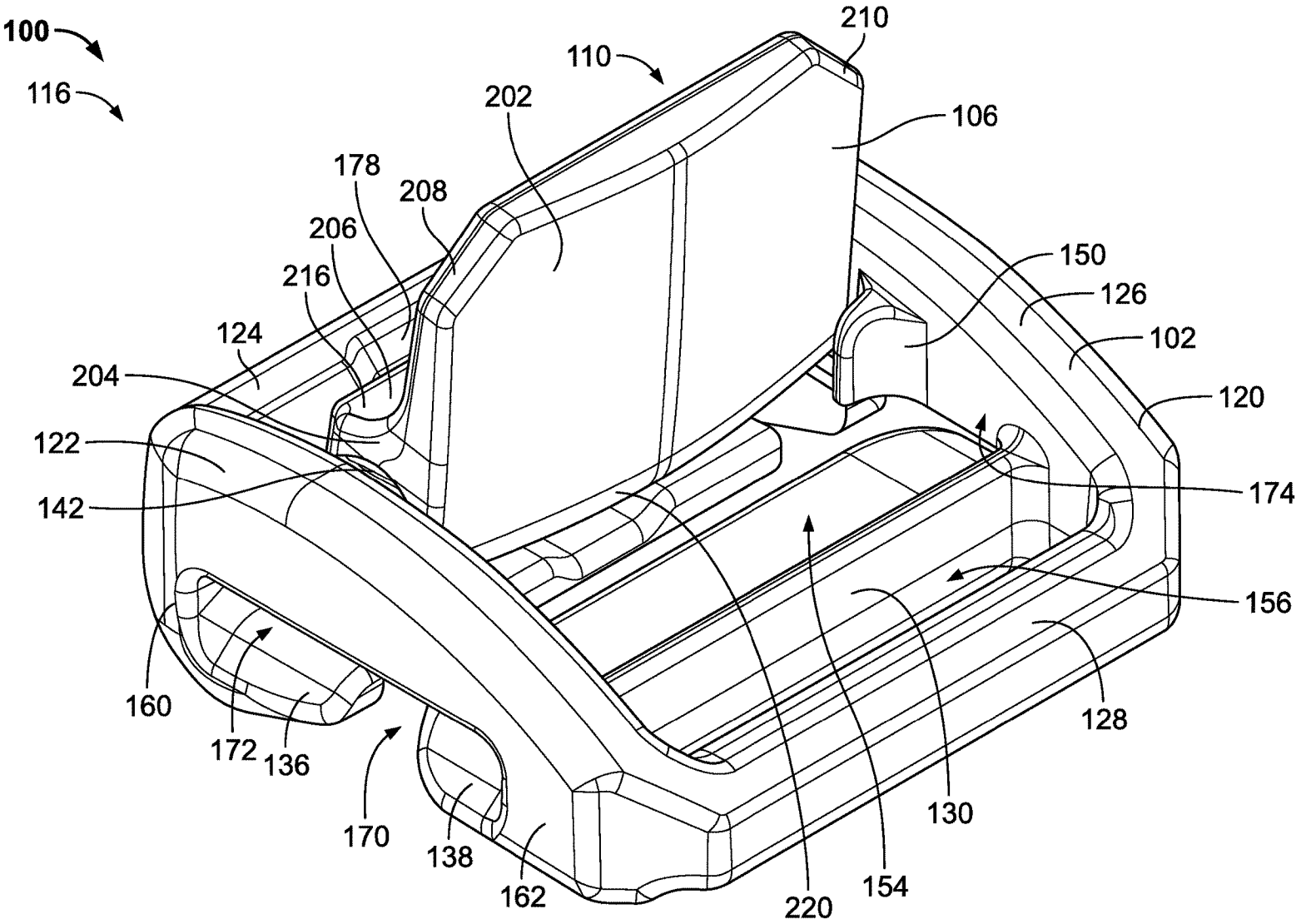
FIG. 1 is an isometric view of a locking slide clip in an open state, according to one exemplary embodiment.
Figure 2:
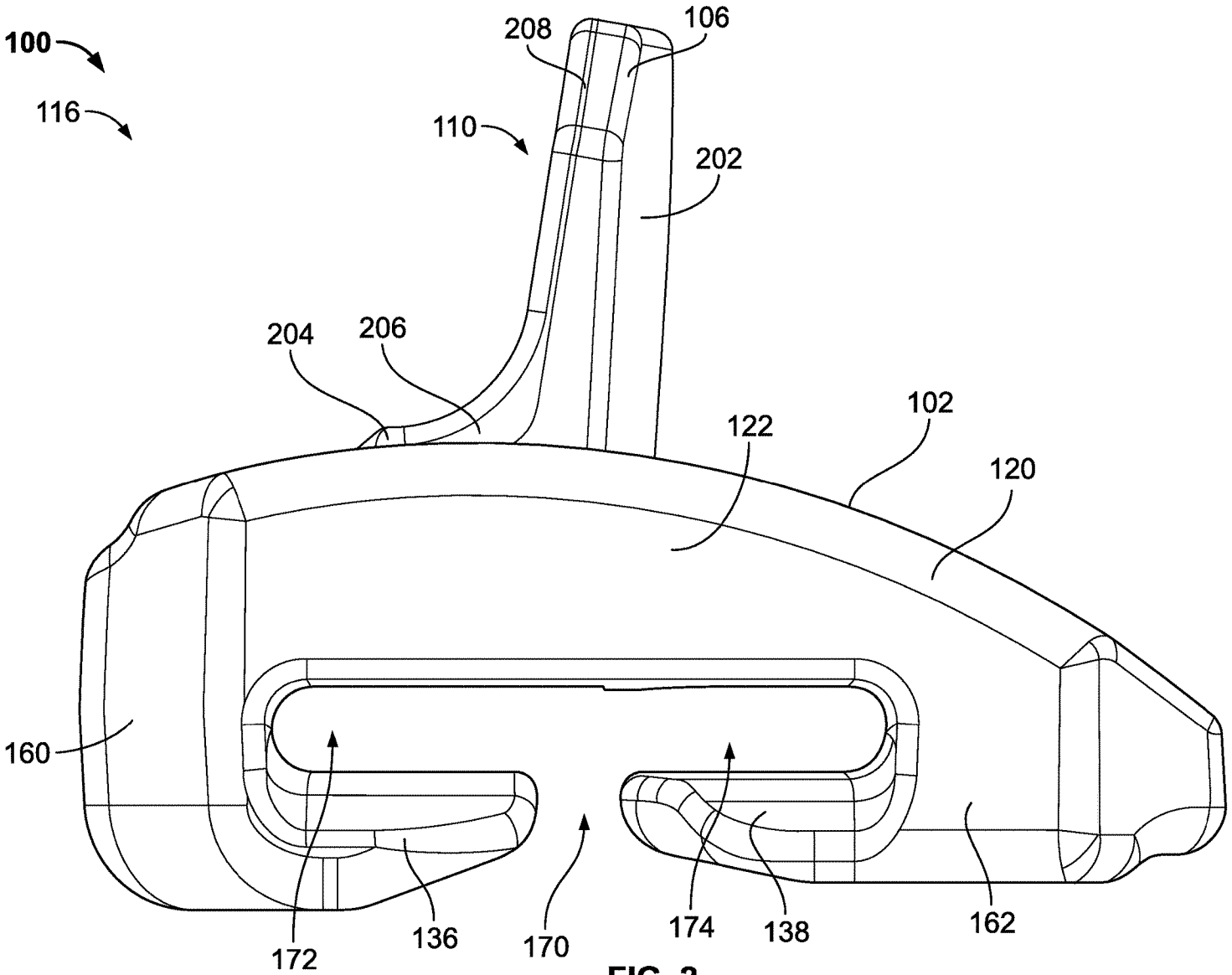
FIG. 2 is a side elevational view of the locking slide clip of FIG. 1 in the open state.

As explained herein, the present disclosure provides a locking position adjustment device that may be quickly and efficiently secured to an article. Further, the locking position adjustment device disclosed herein may be quickly and efficiently manufactured. As a non-limiting example, the locking position adjustment device may be configured as a locking slide clip to engage with a webbing rail of an article, e.g., a bag, a tarp, a cover, etc. In an open position, the locking slide clip may adjustably slide along the webbing rail. In a closed position, the locking slide clip may clamp onto the webbing rail to lock the locking slide clip at a desired position along the rail.

With reference to FIGS. 1-17, the locking slide clip 100 includes a body 102 and a door 106. The door 106 is hingedly engaged with the body 102. The door 106 may be selectively placed in an unlocked position 110 relative to the body 102, as shown in FIGS. 1-3, 14, and 15. The door 106 may be selectively placed in a locked position 112 relative to the body 102, as shown in FIGS. 4-7, 16, and 17. The door 106 pivotably moves relative to the body 102 between the unlocked position 110 and the locked position 112. Thus, the locking slide clip 100 is in an open state 116 when the door 106 is in the unlocked position 110, as shown in FIGS. 1-3, 14, and 15. Further, the locking slide clip 100 is thus in a closed state 118 when the door 106 is in the locked position 112, as shown in FIGS. 4-7, 16, and 17. In some embodiments, the locking slide clip 100 is made of stiff plastic (e.g., polyoxymethylene (POM), acrylonitrile butadiene styrene (ABS), nylon, polyethylene, etc.).

With reference to FIGS. 1-10 and 14-17, the body 102 includes an upper portion 120. Looking more specifically at FIGS. 3 and 10, the upper portion includes a first wall 122, a second wall 124, a third wall 126, a fourth wall 128, and a fifth wall 130. The body 102 further includes a first leg 136, a second leg 138, a first hinge post 142, a second hinge post 144, a first stop tab 148, and a second stop tab 150.

Figure 3:
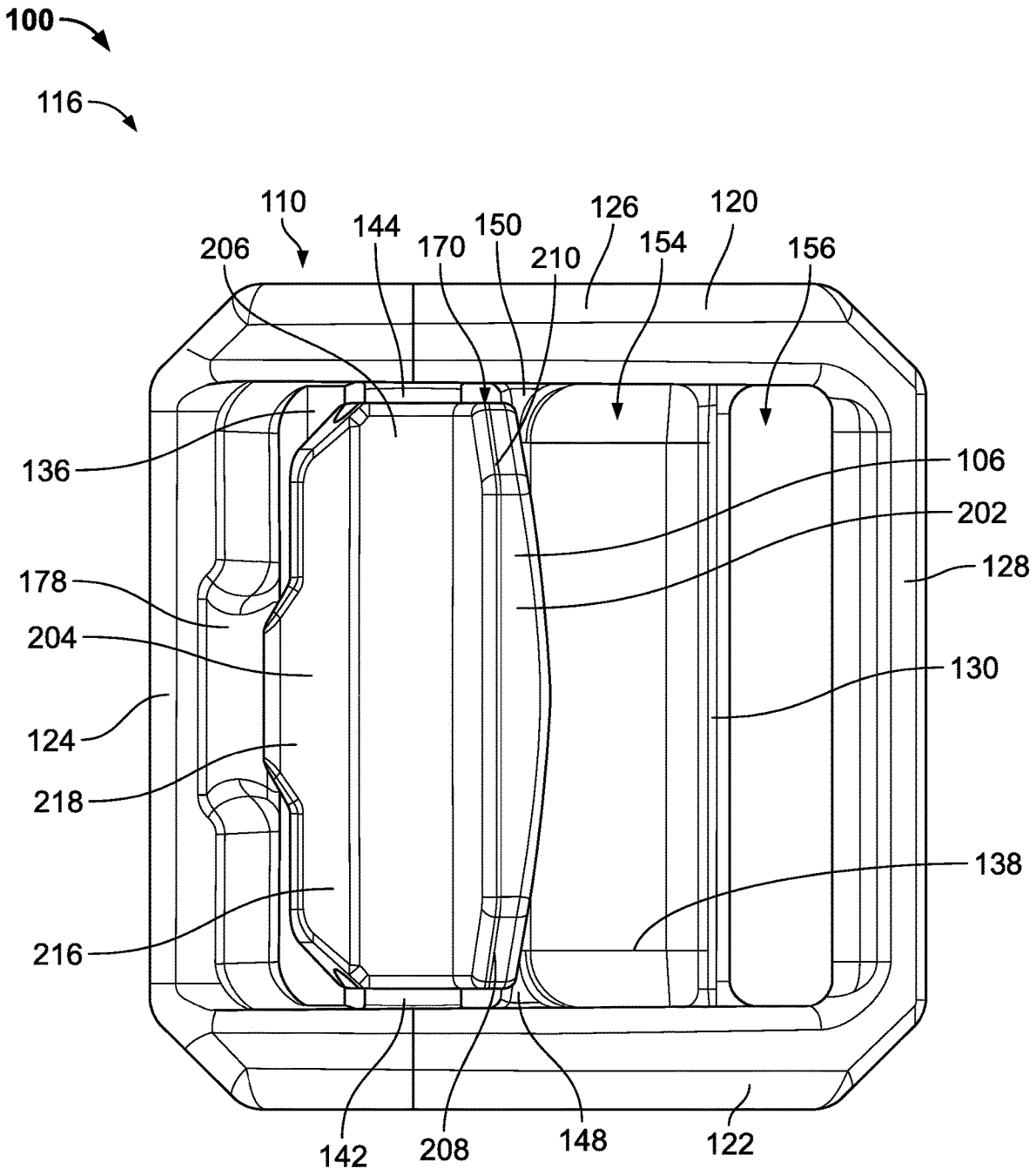
FIG. 3 is a top view of the locking slide clip of FIGS. 1 and 2 in the open state.
Figure 4:
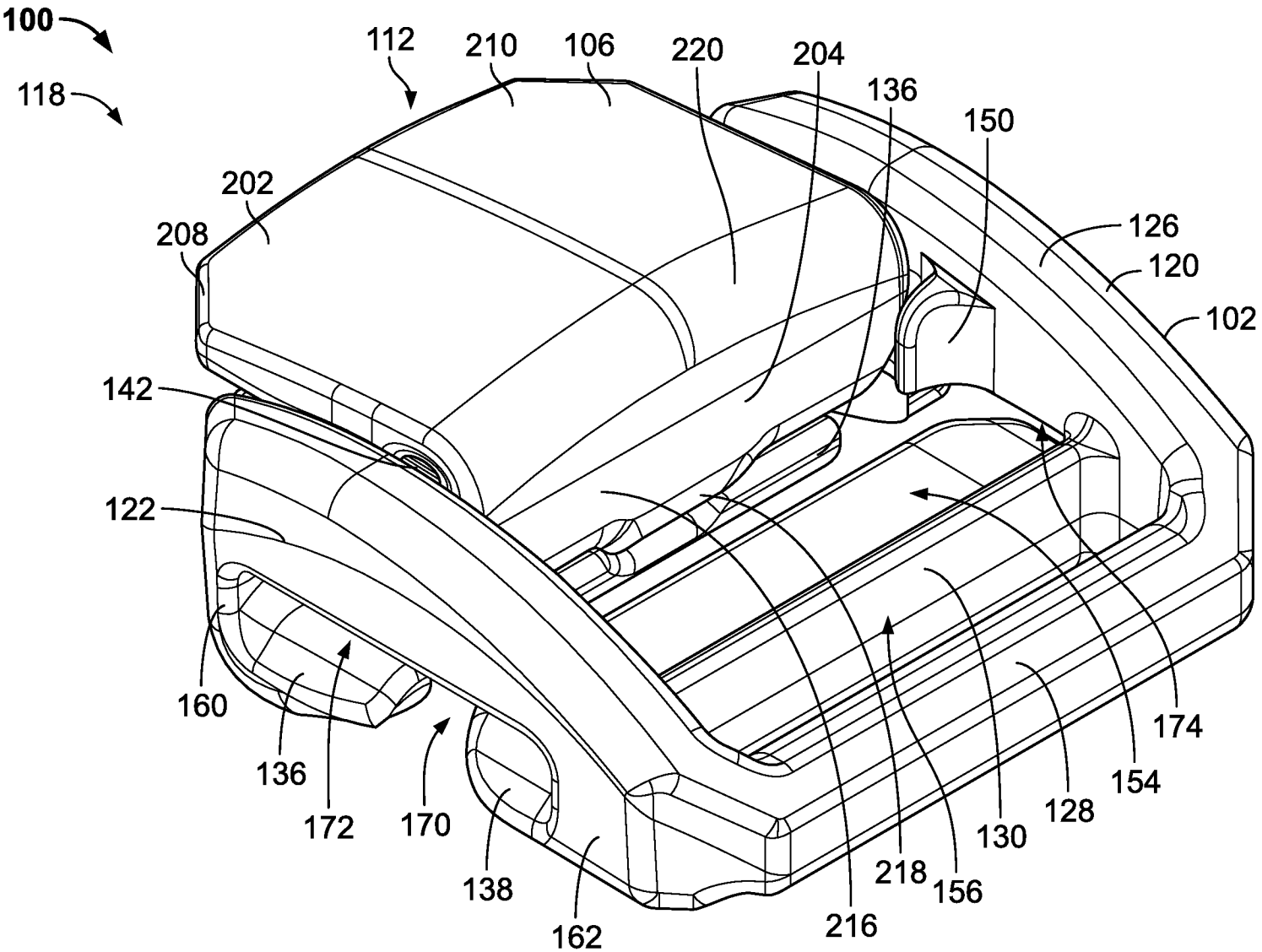
FIG. 4 is another isometric view of the locking slide clip of FIGS. 1-3 in a closed state.
Figure 5:
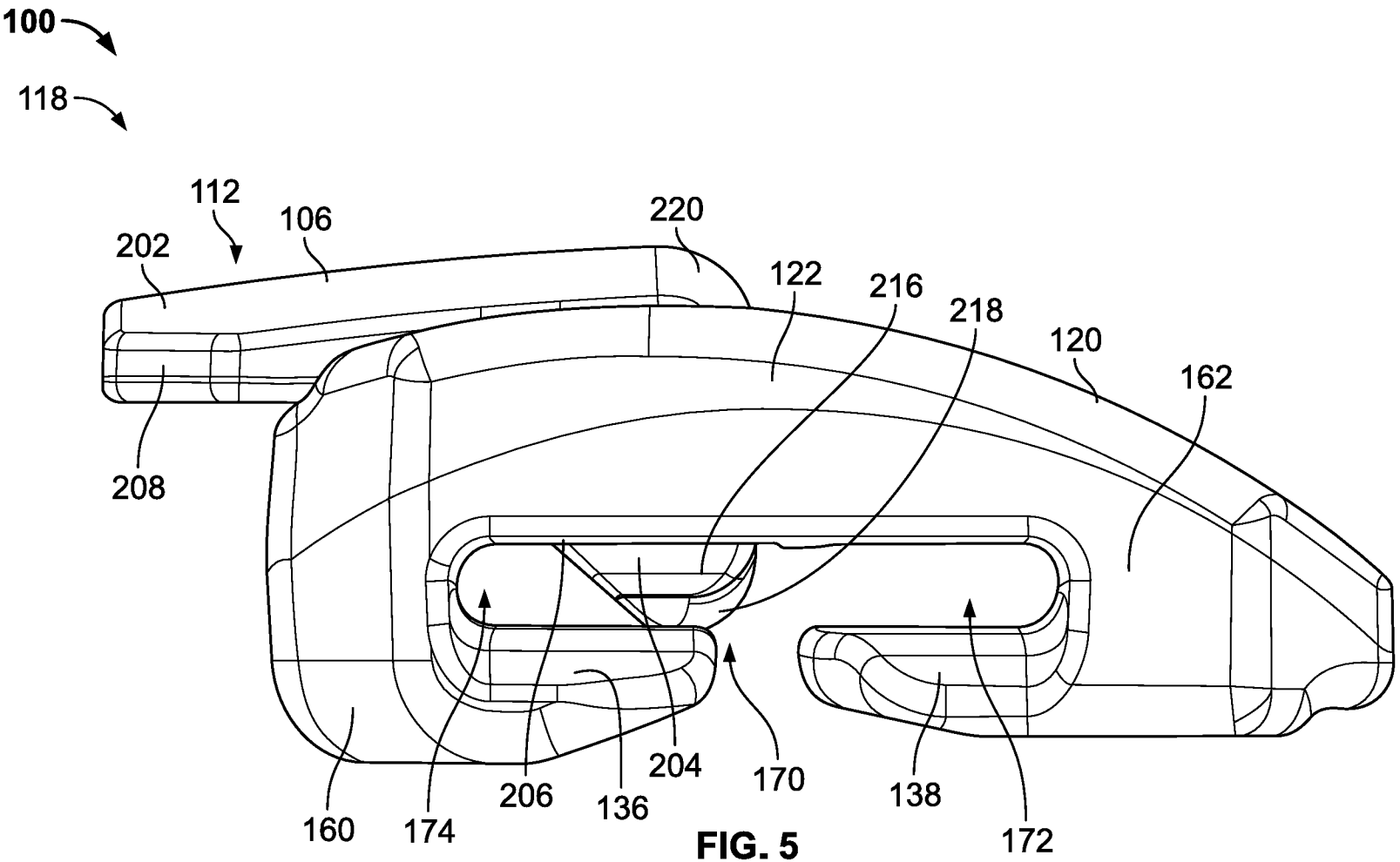
FIG. 5 is a side elevational view of the locking slide clip of FIGS. 1-4 in the closed state.
Figure 10:
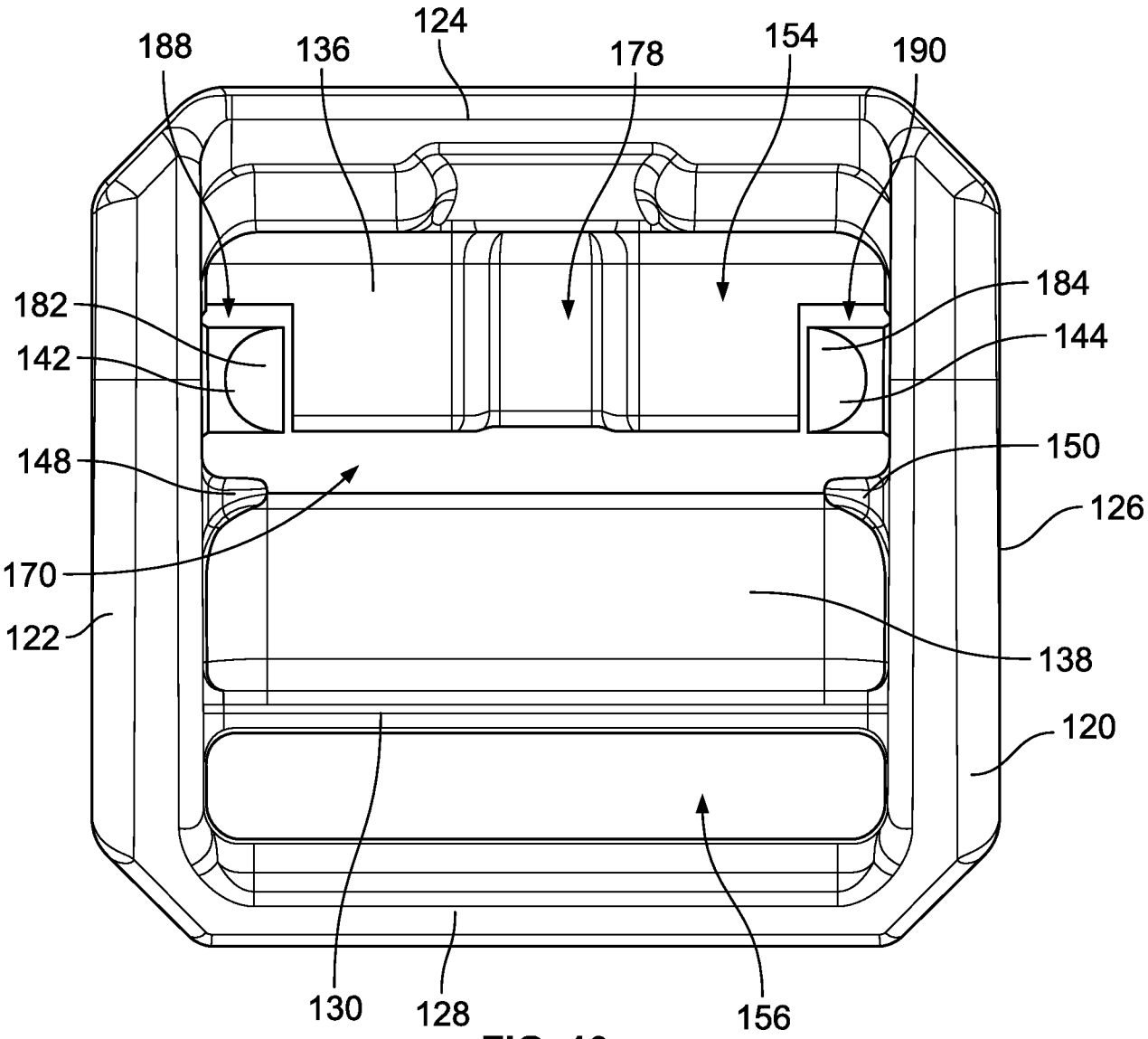
FIG. 10 is a top view of the body of FIGS. 8 and 9.

Still looking at FIGS. 3 and 10, more specifically, the first wall 122 is connected and generally perpendicular to the second wall 124, the fourth wall 128, and the fifth wall 130. The third wall 126 is connected and generally perpendicular to the second wall 124, the fourth wall 128, and the fifth wall 130. The second wall 124 and the fourth wall 128 are opposite one another. The fifth wall 130 is between the second wall 124 and the fourth wall 128. The first wall 122 and the third wall 126 are opposite and generally parallel to one another. Further, the first wall 122 and the third wall 126 are mirror images of one another. The second wall 124 and the fourth wall 128 are opposite one another. The second wall 126, the fourth wall 128, and the fifth wall 130 are generally parallel to one another. Thus, the first, second, third, and fourth walls 122, 124, 126, 128 form a generally rectilinear perimeter. Further, the first, second, third, and fifth walls 122, 124, 126, 130 define a door cavity 154. The first, third, fourth, and fifth walls 122, 126, 128, 130 define a strap opening 156. Thus, a strap (e.g., a sternum strap, a shoulder strap, webbing, etc.) may be passed through the strap opening 156 to attach to the fourth wall 128 (not shown).

With reference again to FIGS. 3 and 10, the first hinge post 142 and the first stop tab 148 are connected to and extend generally perpendicularly from the first wall 122 inwardly into the door cavity 154. Additionally, the second hinge post 144 and the second stop tab 150 are connected to and extend generally perpendicularly from the third wall 126 inwardly into the door cavity 154. The first hinge post 142 opposes and is a mirror image of the second hinge post 144. The first stop tab 148 opposes and is a mirror image of the second stop tab 150.

With reference to FIGS. 1, 2, 4, 5, and 7, the body 102 further includes a first connecting portion 160 and a second connecting portion 162. The first and second connecting portions 160, 162 extend generally perpendicularly from the first wall 122. The first leg 136 extends generally perpendicularly from the first connecting portion 160 below the upper portion 120. Thus, the first leg 136 is connected and generally parallel to the first wall 122 via the first connecting portion 160. The second leg 138 extends generally perpendicularly from the second connecting portion 162 below the upper portion 120. Thus, second leg 138 is connected and generally parallel to the first wall 122 via the second connecting portion 162. Similarly, with reference to FIGS. 7-9, the body also includes a third connecting portion 164 and a fourth connecting portion 166. The third and fourth connecting portions 164, 166 extend from the third wall 126. The first leg 136 extends generally perpendicularly from the third connecting portion 164 below the upper portion 120. Thus, first leg 136 is connected to the third wall 126 via the third connecting portion 164. The second leg 138 extends generally perpendicularly from the fourth connecting portion 166 below the upper portion 120. Thus, second leg 138 is connected and generally parallel to the third wall 126 via the fourth connecting portion 166.

With reference to FIGS. 3, 7, 10, 15, and 17, the first leg 136 is further connected to and extends generally perpendicularly from the second wall 124. Additionally, the second leg 138 is further connected to and extends generally perpendicularly from the fifth wall 130. Looking specifically at FIG. 7, the second wall 124 is connected to the first connecting portion 160 and the third connecting portion 164. Additionally, the fifth wall 130 is connected to the second connecting portion 162 and the fourth connecting portion 166. Thus, looking at FIGS. 1, 2, 4, 5, 8, 9, 15, and 17, the body 102 is generally C-shaped. In other words, with reference to FIG. 8, the first leg 136 and the second wall 124 form a first hook 167. Similarly, the second leg 138 and the fifth wall 130 form a second hook 168.

With reference to FIGS. 1-10, 15, and 17 the first leg 136 and the second leg oppose one another. Additionally, the first leg 136 and the second leg 138 extend toward one another. Thus, the first leg 136 and the second leg 138 define a stitching slot 170 between one another. The stitching slot 170 is in communication with thee door cavity 154.

With reference to FIGS. 1, 2, 4, 5, and 7, the upper portion 120, the first leg 136, and the second leg 138 define a first rail opening 172. More specifically, the first wall 122, the first connecting portion 160, the second connecting portion 162, the first leg 136, and the second leg 138 define the first rail opening 172. The first rail opening 172 is in communication with the door cavity 154 and the stitching slot 170. Similarly, with reference to FIGS. 7-9, 15, and 17 the upper portion 120, the first leg 136, and the second leg 138 define a second rail opening 174. More specifically, the third wall 126, the third connecting portion 164, the fourth connecting portion 166, the first leg 136, and the second leg 138 define the second rail opening 174. The second rail opening 174 is in communication with the door cavity 154, the stitching slot 170, and the first rail opening 172.

With reference to FIGS. 1, 3, 8, 10, 15, and 17, the second wall 124 and the first leg 136 define a cam channel 178. The cam channel 178 is in communication with the door cavity 154.

Figure 8:
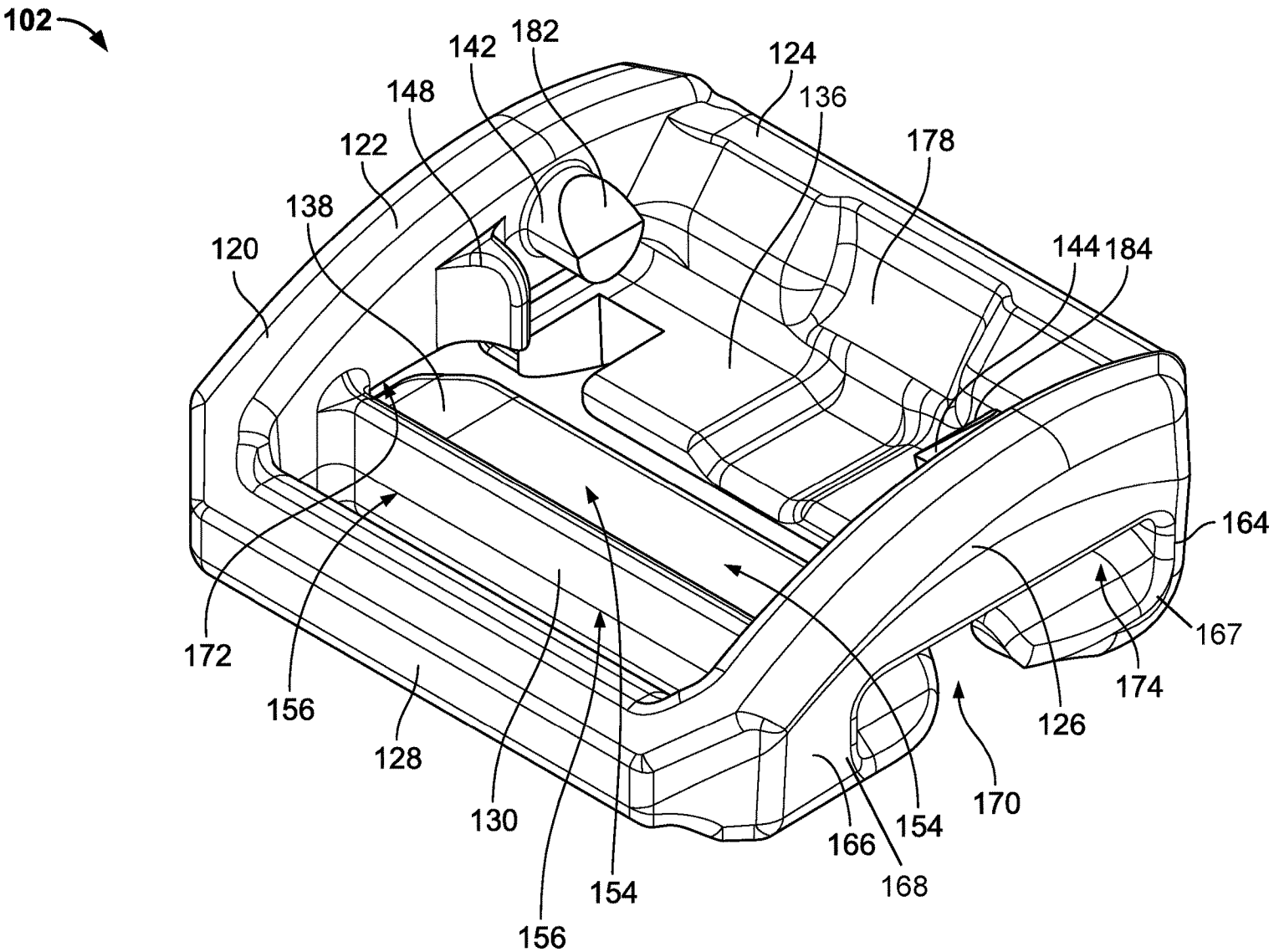
FIG. 8 is an isometric view of a body of the locking slide clip of FIGS. 1-7.
Figure 9:
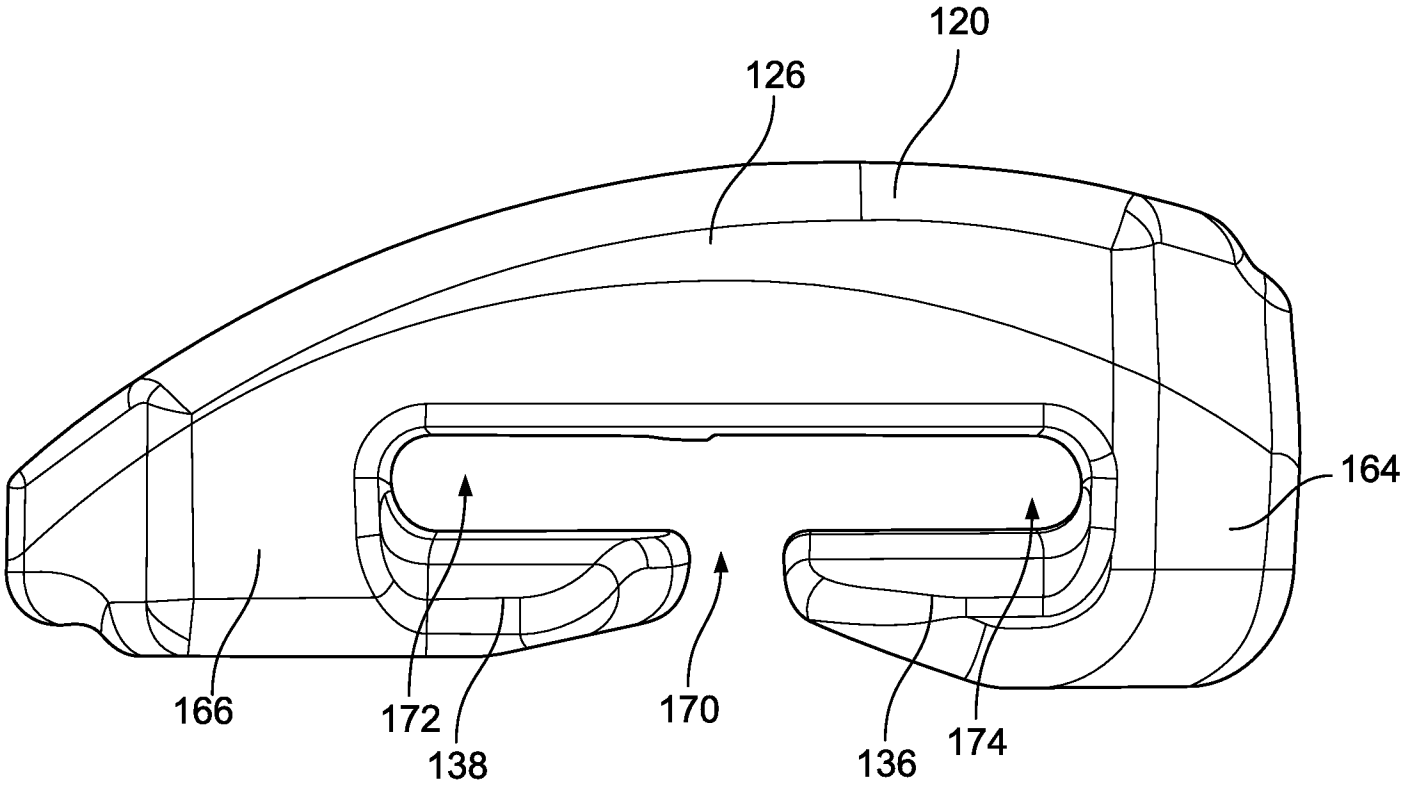
FIG. 9 is a side elevational view of the body of FIG. 8.

With reference to FIGS. 8 and 10, the first hinge post 142 includes a first lead-in feature 182. Similarly, the second hinge post 144 includes a second lead-in feature 184. In the illustrated example, the first and second lead-in features 182, 184 are depicted as chamfers. In some embodiments, the first and/or second lead-in features 182, 184 may be formed as radii (not shown).

Figure 7:
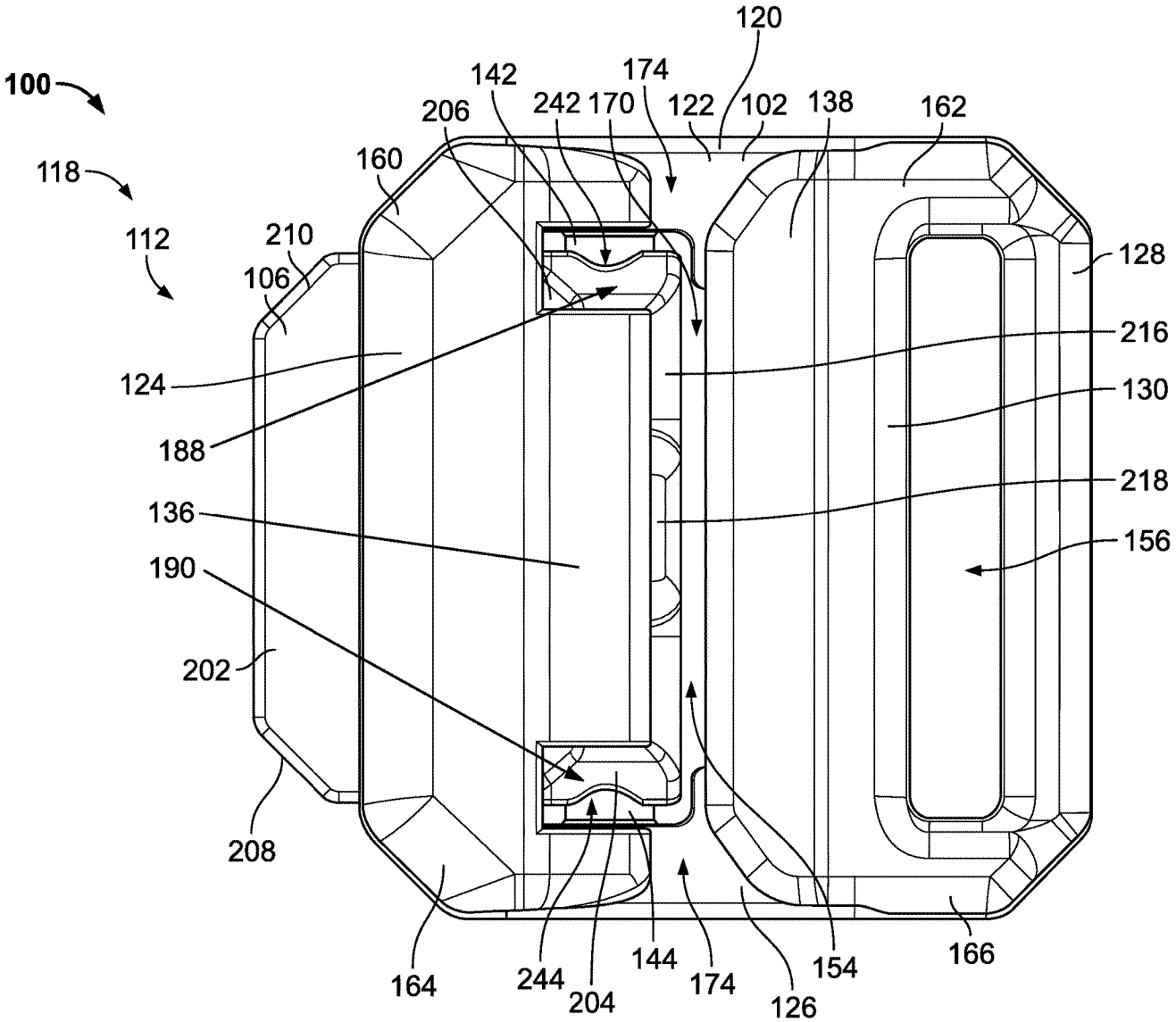
FIG. 7 is a bottom view of the locking slide clip of FIGS. 1-6 in the closed state.

With reference to FIGS. 7 and 10, the first leg 136 defines a first cutout 188 and a second cutout 190. The first and second cutouts 188, 190 are mirror images of one another and are respectively aligned with the first and second hinge posts 142, 144. It should be appreciated that the first and second cutouts 188, 190 permit production of the body 102 in a manufacturing mold as a single, unitary piece. In other words, the first wall 122, the second wall 124, the third wall 126, the fourth wall 128, the fifth wall 130, the first leg 136, the second leg 138, the first hinge post 142, the second hinge post 144, the first stop tab 148, and the second stop tab 150 are integrally, continuously, and transitionally connected to one another.

With reference to FIGS. 1-3, 5, 7, 11, 12, 14, 15, and 17, the door 106 includes a handle portion 202, a locking portion 204, and a curved transition portion 206. The handle portion 202 extends from the locking portion 204. More specifically, the locking portion 204 and the handle portion 202 are transitionally connected to one another via the transition portion 206. The handle portion 202 defines a first cutaway 208 and a second cutaway 210. In the illustrated embodiment, the first and second cutaways 208, 210 are formed as chamfers. The first and second cutaways 208, 210 work to prevent the door 106 from snagging a user's clothing (e.g., a scarf, a necklace, etc.) and to prevent inadvertent movement of the door 106 from the locked position 112 of FIGS. 4-7, 16, and 17 to the unlocked position of FIGS. 1-3, 14, and 15. It should be understood that the first and second cutaways 208, 210 may be any shape (e.g., curvilinear, radii, etc.).

With reference to FIGS. 4, 5, 11, and 12, the locking portion 204 includes a first protrusion 216, a second protrusion 218, and a hinge portion 220. The first protrusion 216 includes opposing first and second slopes 222, 224. The second protrusion 218 includes opposing third and fourth slopes 226, 228. The first and second protrusions 216, 218 also define a fifth slope 230. The first protrusion 216 extends from the hinge portion 220 generally perpendicularly relative to the handle portion 202. The second protrusion 218 is disposed along and extends from the first protrusion 216 generally perpendicularly relative to the handle portion 202. Thus, the second protrusion 218 is stepped relative to the first protrusion 216. In other words, the second protrusion 218 is transitionally connected to the first protrusion 216 via the third and fourth slopes 226, 228 to extend further from the hinge portion 220 than the first protrusion 216.

It should be appreciated that the cam channel 178 of FIGS. 1, 3, 8, 10, 15, and 17 is sized and configured to accommodate the second protrusion 218 of FIGS. 4, 5, 11, 12, 15, and 17. In operation, as the door 106 moves from the unlocked position 110 of FIGS. 1-3, 14, and 15 to the locked position 112 of FIGS. 4-7, 16, and 17 and vice versa, the first protrusion 216 passes through the door cavity 154 and the second protrusion 218 passes through the cam channel 178.

Figure 11:
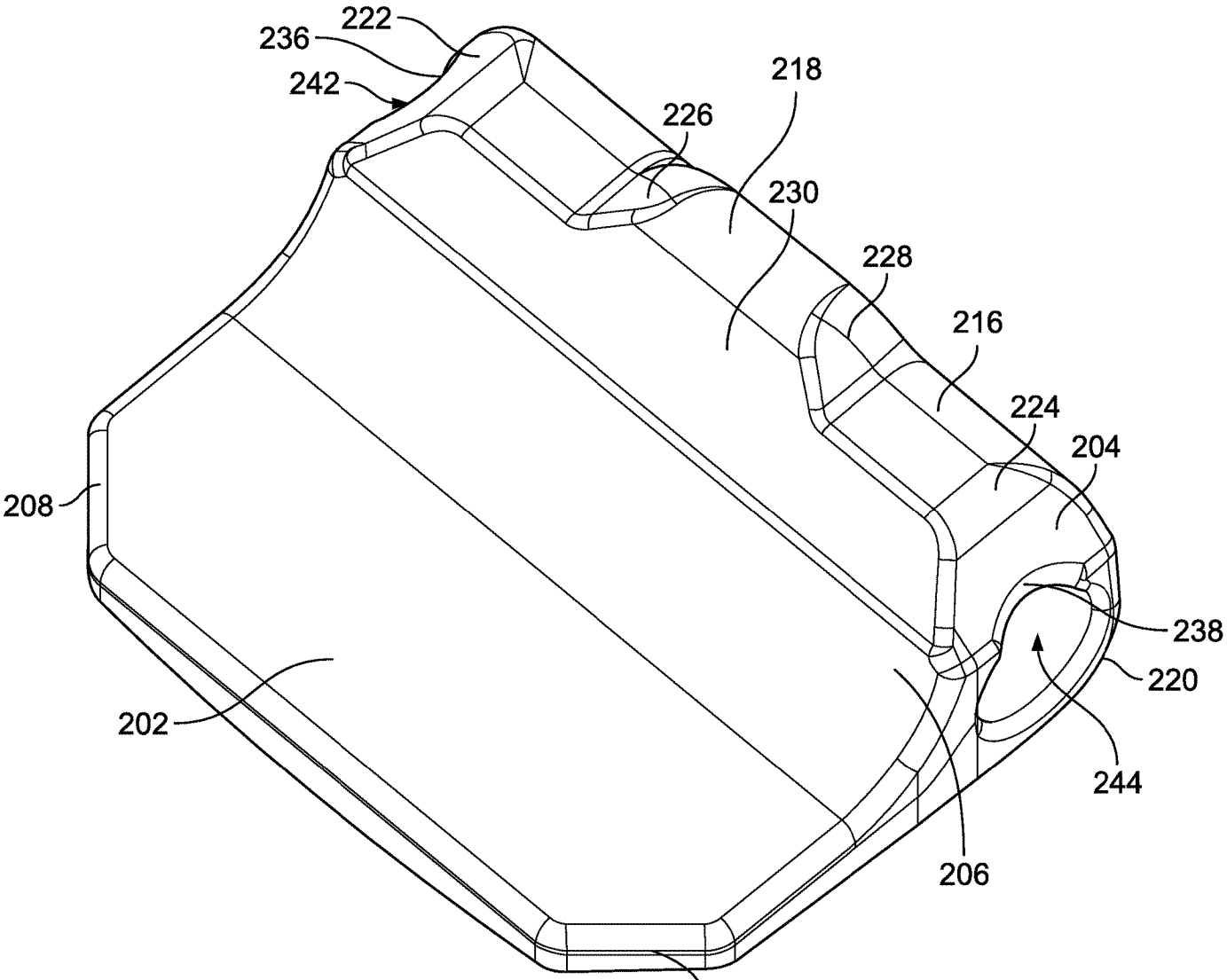
FIG. 11 is an isometric view of a door of the locking slide clip of FIGS. 1-7.
Figure 12:
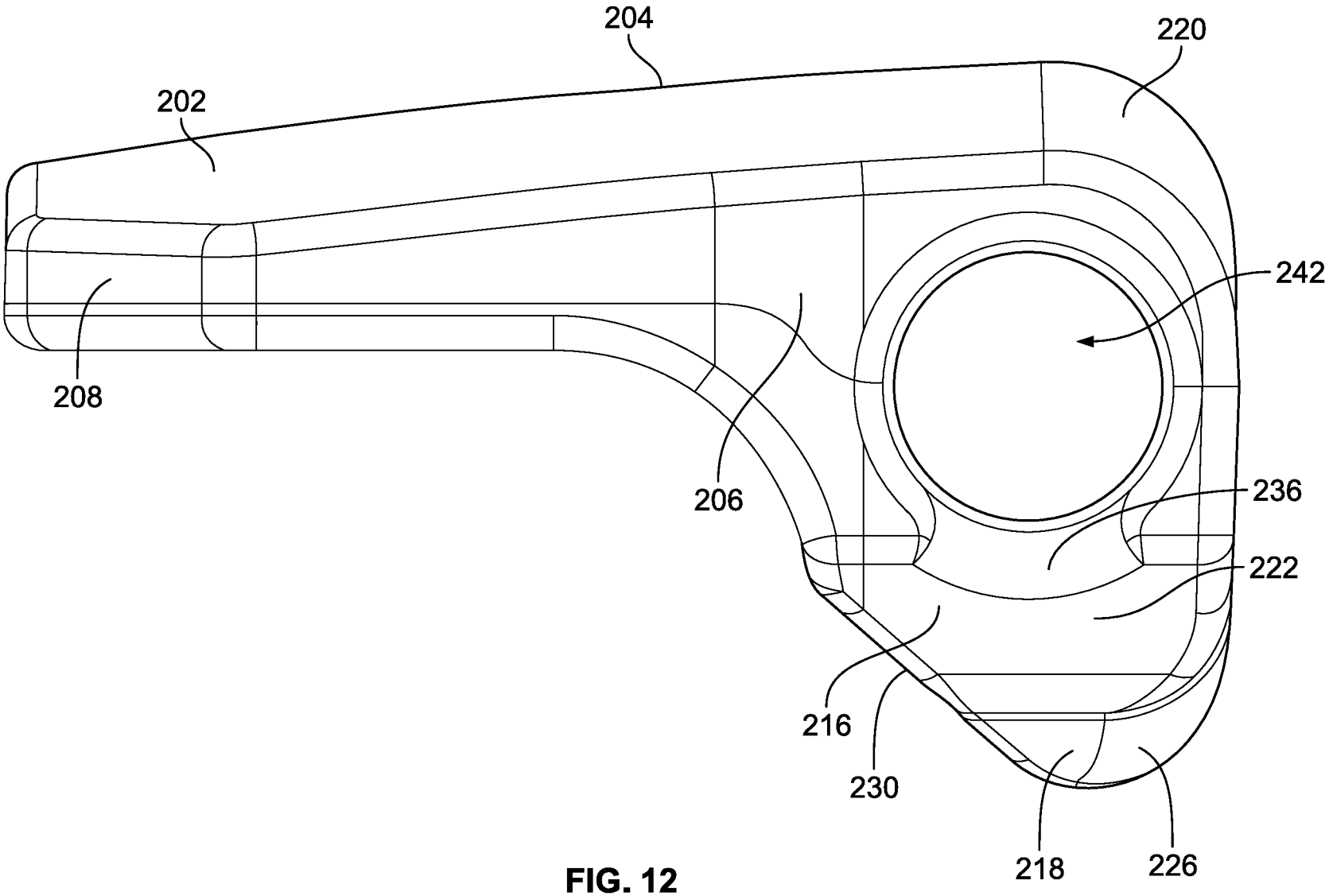
FIG. 12 is a side elevational view of the door of FIG. 11.
Figure 13:
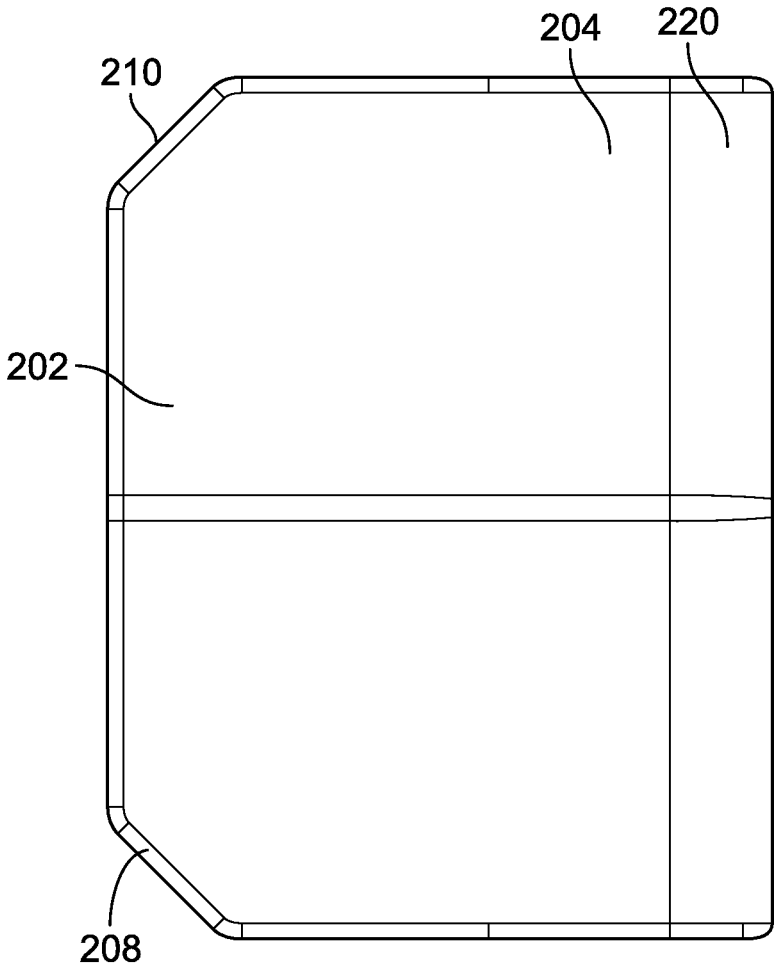
FIG. 13 is a top view of the door of FIGS. 11 and 12.

With specific reference to FIG. 12, the hinge portion 220 has a third lead-in feature 236. The first slope 222 is transitionally connected to the third lead-in feature 236. Similarly, looking particularly at FIG. 11, the hinge portion 220 has a fourth lead-in feature 238. The first slope 222 is transitionally connected to the third lead-in feature 238. It should be appreciated that the third and fourth lead-in features 236, 238 are mirror images of one another.

Returning to FIG. 12, the hinge portion 220 defines a first well 242. The third lead-in feature 236 partially defines the first well 242. Thus, the first slope 222 is transitionally connected to the first well 242 via the third lead-in feature 236. The first well 242 is sized and configured to receive the first hinge post 142 of FIGS. 3, 4, 6, 7, 8, and 10. Similarly, looking back to FIG. 11, the hinge portion 220 defines a second well 244. The fourth lead-in feature 238 partially defines the second well 244. Thus, the second slope 224 is transitionally connected to the second well 244 via the fourth lead-in feature 238. The second well 244 is sized and configured to receive the second hinge post 144 of FIGS. 3, 6, 7, 8 and 10. It should be appreciated that the first and second wells 242, 244 are mirror images of one another.

With reference to FIGS. 1, 3, 4, 6, 7, and 14-17 when the locking slide clip 100 is assembled, the door 106 is disposed in the door cavity 154 to pivotably engage the body 102. More specifically, referring to FIGS. 3 and 6, the door 106 is pivotably engaged with the upper portion 120 opposite the stitching slot 170 via the first and second hinge posts 142, 144. In other words, looking particularly at FIG. 7, when the locking slide clip 100 is assembled, the first hinge post 142 is rotatably disposed in the first well 242. Similarly, still referring to FIG. 7, when the locking slide clip 100 is assembled, the second hinge post 144 is rotatably disposed in the second well 244. Thus, the door 106 may pivot relative to the body 102 about the first and second hinge posts 142, 144. Additionally, looking at FIGS. 3, 15, and 17, when the locking slide clip 100 is assembled, the second protrusion 218 is disposed in the cam channel 178.

Figure 6:
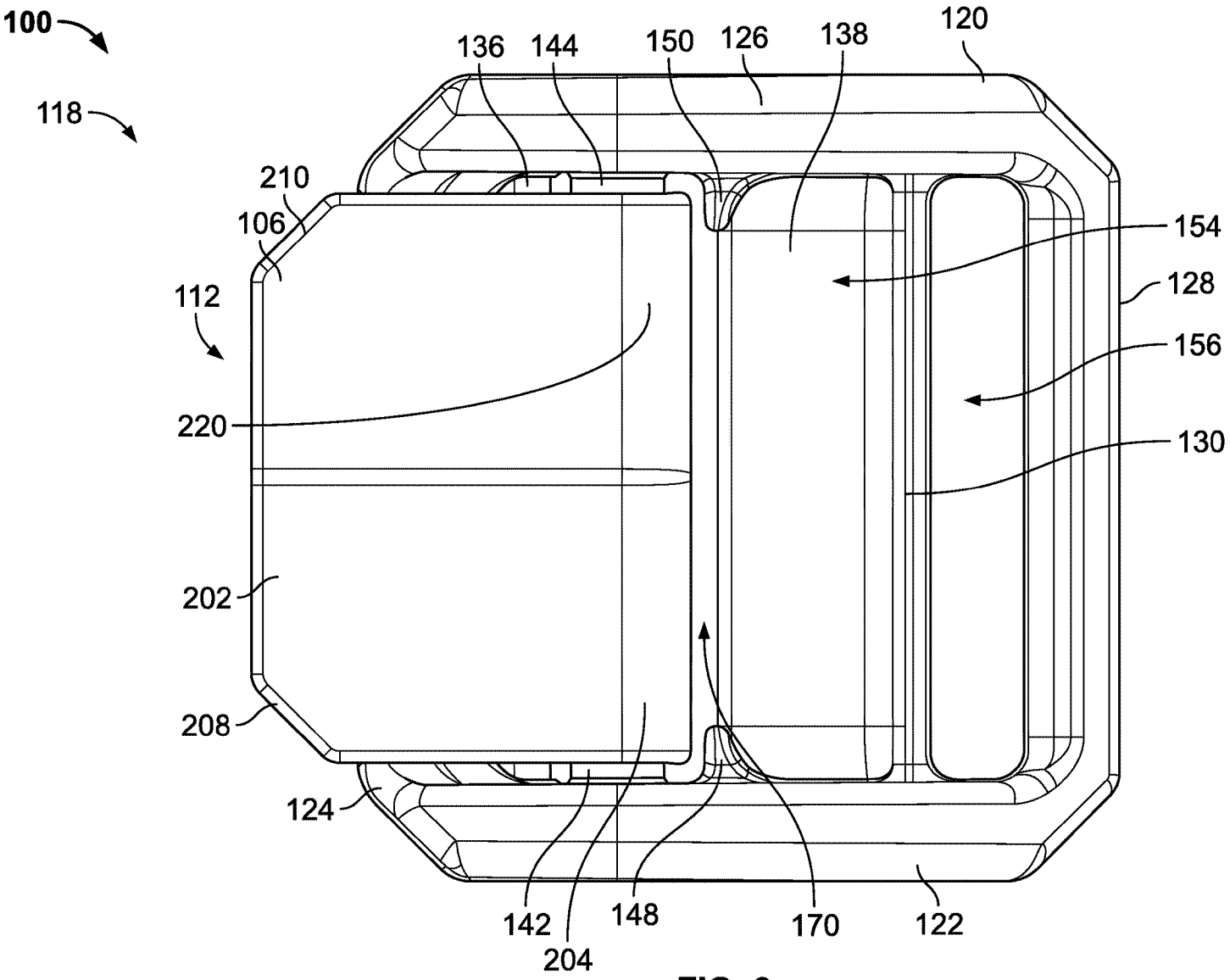
FIG. 6 is a top view of the locking slide clip of FIGS. 1-5 in the closed state.

Referring to FIGS. 3 and 6, in operation, pivoting movement of the door 106 is limited by the second wall 124 and the first and second stop tabs 148, 150. With specific reference to FIG. 3, the first and second stop tabs 148, 150 contact the door 106 to provide a hard stop when the door 106 reaches the unlocked position 110. Similarly, with specific reference to FIG. 6, the second wall 124 contacts the door 106 to provide a hard stop when the door 106 reaches the locked position 112.

Figure 15:
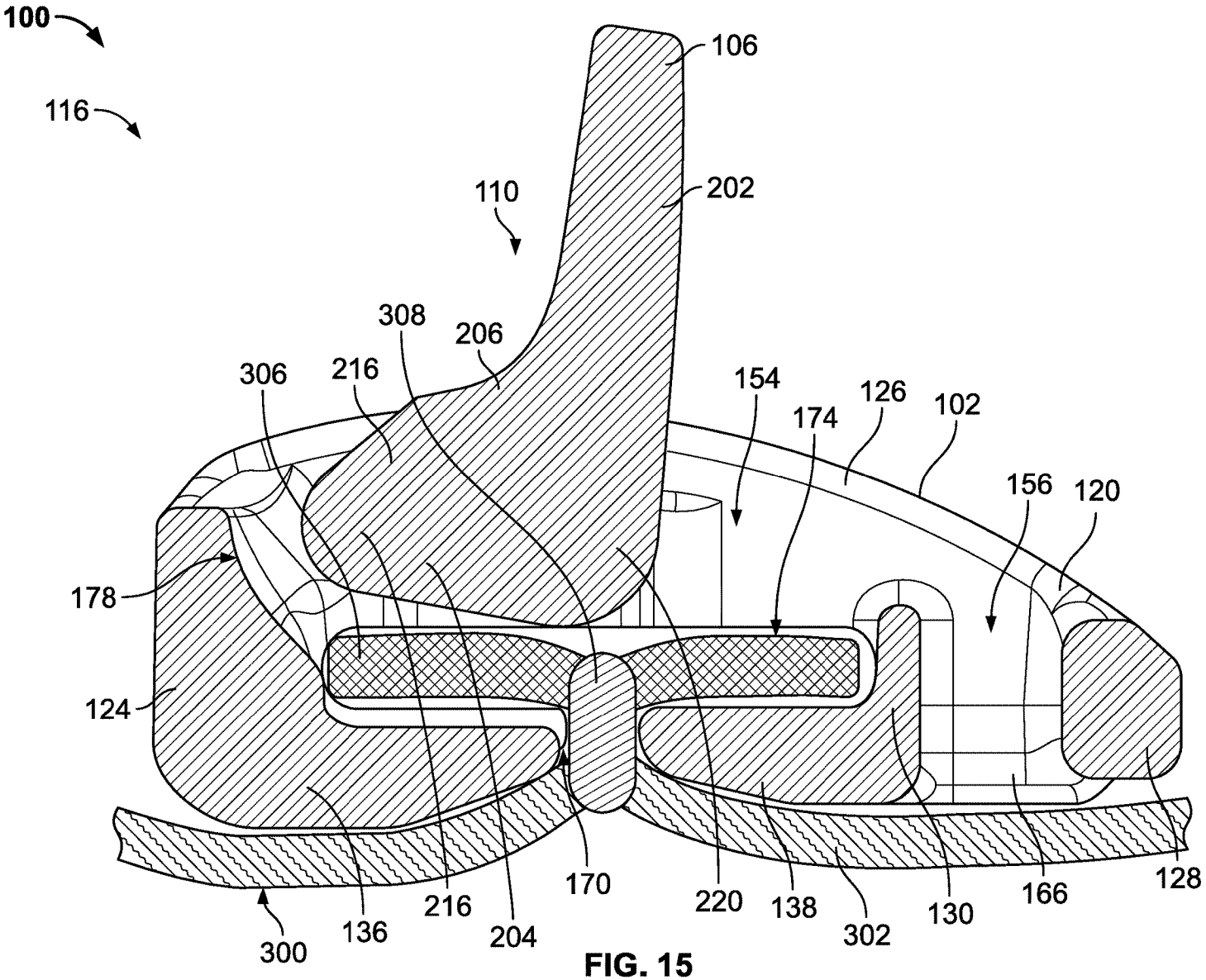
FIG. 15 is a partial cross-sectional view of the locking slide clip of FIGS. 1-7 and 14 in the open state of FIGS. 1-3 and 14 as assembled with the article of FIG. 14, taken along the line 15-15 of FIG. 14.

With reference to FIGS. 1, 3, and 15, when the door 106 is in the unlocked position 110, the locking portion 204 faces the second wall 124. Further, looking at FIGS. 4, 5, 7, and 17, when the door 106 is in the locked position 112, the locking portion 204 faces the first and second legs 136, 138. In other words, when the when the door 106 is in the locked position 112, the locking portion 204 faces the stitching slot 170.

It should be appreciated that as the locking slide clip 100 is assembled, the first lead-in feature 182 of FIGS. 8 and 10 slidingly contacts the first slope 222 and the third lead-in feature 236 of FIGS. 11 and 12 to guide the first hinge post 142 of FIGS. 1, 3, 4, 6, 7, 8, and 10 into the first well 242 of FIGS. 11 and 12. Similarly, it should also be appreciated that as the locking slide clip 100 is assembled, the second lead-in feature 184 of FIGS. 8 and 10 slidingly contacts the second slope 224 and the fourth lead-in feature 238 of FIG. 11 to guide the second hinge post 144 of FIGS. 3, 6, 7, 8, and 10 into the second well 244 of FIG. 11.

It should additionally be appreciated that as the locking slide clip 100 is assembled, the door 106 of FIGS. 1-7 and 11-17 resiliently deflects the body 102 of FIGS. 1-10 and 14-17 to push the first and third walls 122, 126 away from one another until the first and second hinge posts 142, 144 of FIGS. 3, 6, 7, 8, and 10 align with the first and second wells 242, 244 of FIGS. 7 and 11. When the first and second hinge posts 142, 144 of FIGS. 3, 6, 7, 8, and 10 are aligned with the first and second wells 242, 244 of FIGS. 7 and 11, the first hinge post 142 snaps into the first well 242 and the second hinge post 144 snaps into the second well 244. In other words, the door 106 of FIGS. 1-7 and 11-17 snapably engages the body 102 of FIGS. 1-10 and 14-17.

With reference to FIGS. 14-17, the locking slide clip 100 is configured to engage with an article 300. The article 300 includes a substrate 302, a webbing rail 306, and stitching 308. The webbing rail 306 is attached to the substrate 302 via the stitching 308. When the locking slide clip 100 is installed on the article 300, the body 102 engages the webbing rail 306. In some embodiments, the article 300 is a backpack. It should be understood that the locking slide clip 100 may be used with any article that includes strapping and/or webbing (e.g., tarps, covers, garments, etc.).

Figure 17:
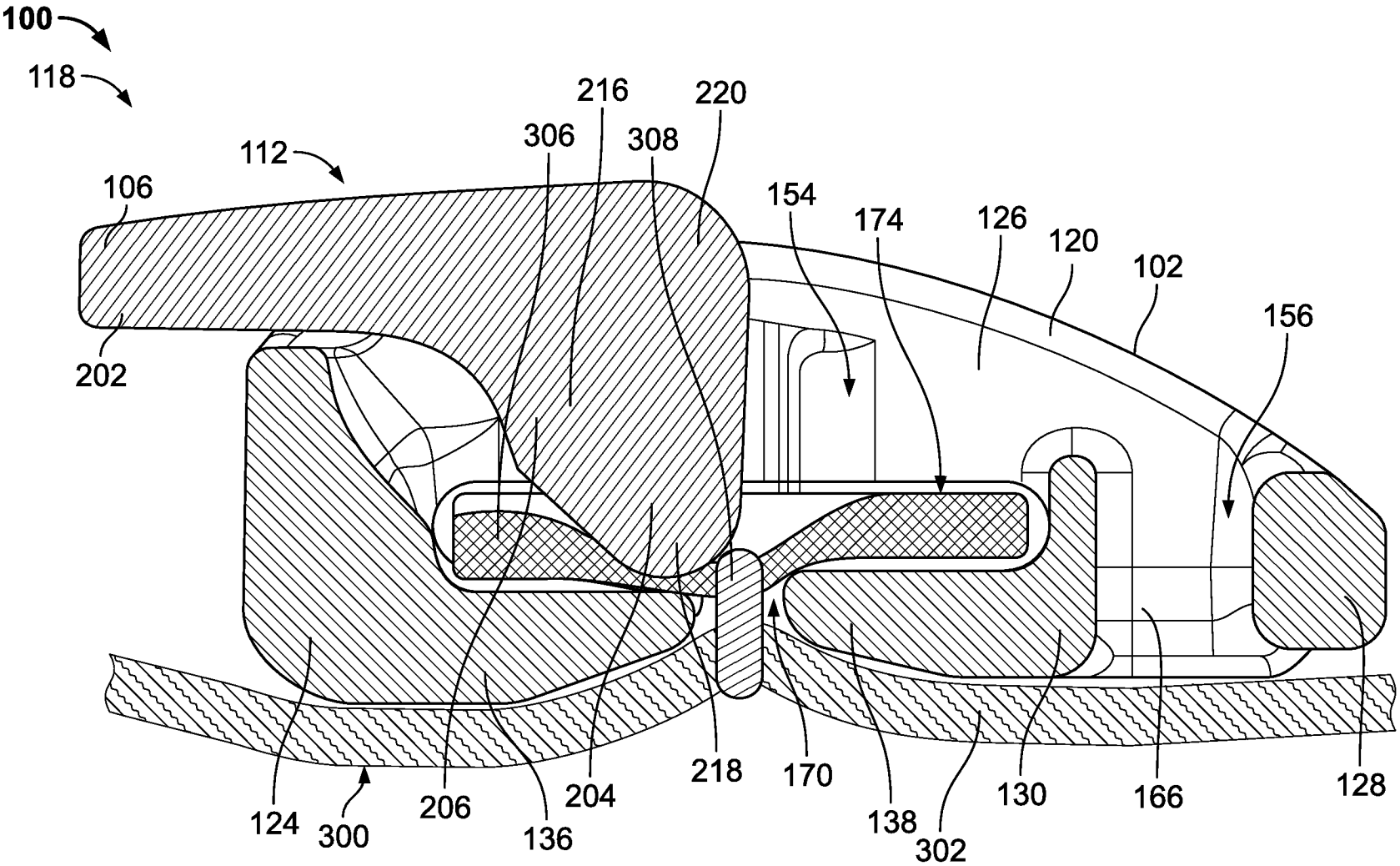
FIG. 17 is a partial cross-sectional view of the locking slide clip of FIGS. 1-7 and 14-16 in the closed state of FIGS. 4-7 and 16 as assembled with the article of FIGS. 14-16, taken along the line 17-17 of FIG. 16.

More specifically, looking at FIGS. 15 and 17, when the locking slide clip 100 is installed on the article 300, the first and second legs 136, 138 are between the substrate 302 and the webbing rail 306. Thus, the webbing rail 306 passes through the second rail opening 174, as shown in FIGS. 15 and 17. It should be understood that when the locking slide clip 100 is installed on the article 300 the webbing rail 306 also passes through the first rail opening 172 of FIGS. 1, 2, 4, 5, 7, 8, and 9 (not shown).

Referring still to FIGS. 15 and 17, when the locking slide clip 100 is installed on the article 300, the webbing rail 306 is captured in the body 102 between first and second legs 136, 138 and the third wall 126. It should be understood that when the locking slide clip 100 is installed on the article 300, the webbing rail 306 is also captured in the body 102 between the first and second legs 136, 138 and the first wall 122 of FIGS. 1, 2, 3, 4, 5, 6, 7, 8, 10, 14, and 16 (not shown).

Referring again to FIGS. 15 and 17, when the locking slide clip 100 is installed on the article 300, the webbing rail 306 is disposed between the door 106 and the first and second legs 136, 138. Additionally, when the locking slide clip 100 is installed on the article 300, the stitching 308 is disposed between the first and second legs 136, 138. Thus, the stitching 308 passes through the stitching slot 170.

Figure 14:
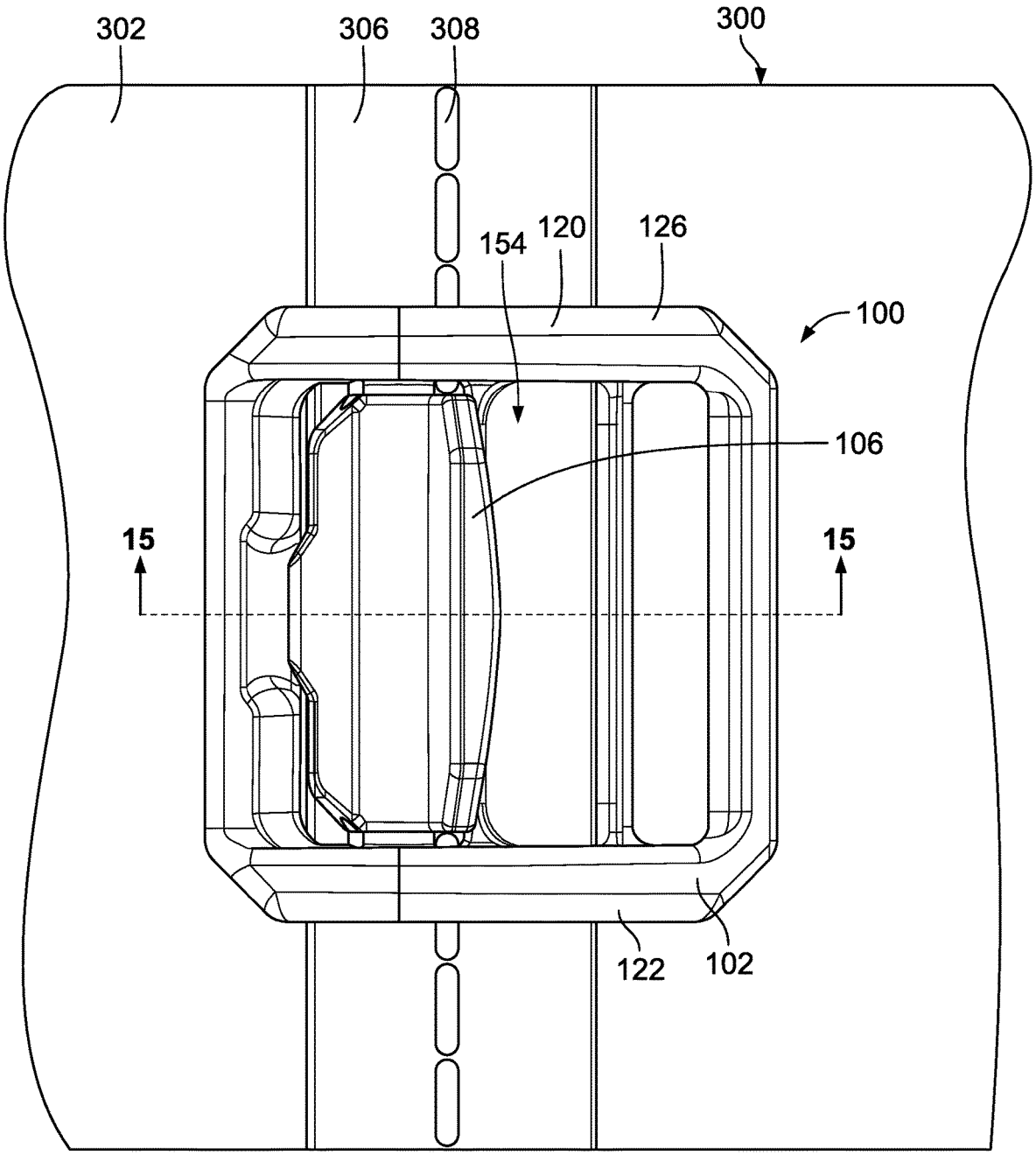
FIG. 14 is a partial top view of the locking slide clip of FIGS. 1-7 in the open state of FIGS. 1-3 as assembled with an article.

With reference to FIGS. 14 and 15, when the locking slide clip 100 is installed on the article 300 and the door 106 is in the unlocked position 110, the locking slide clip 100 slides freely along the webbing rail 306. Referring specifically to FIG. 15, when the locking slide clip 100 is installed on the article 300 and the door 106 is in the unlocked position 110, the substrate 302, the webbing rail 306, and the stitching 308 slide freely along the first and second legs 136, 138. Further, when the locking slide clip 100 is installed on the article 300 and the door 106 is in the unlocked position 110, the webbing rail 306 and the stitching 308 slide freely along the door 106.

Figure 16:
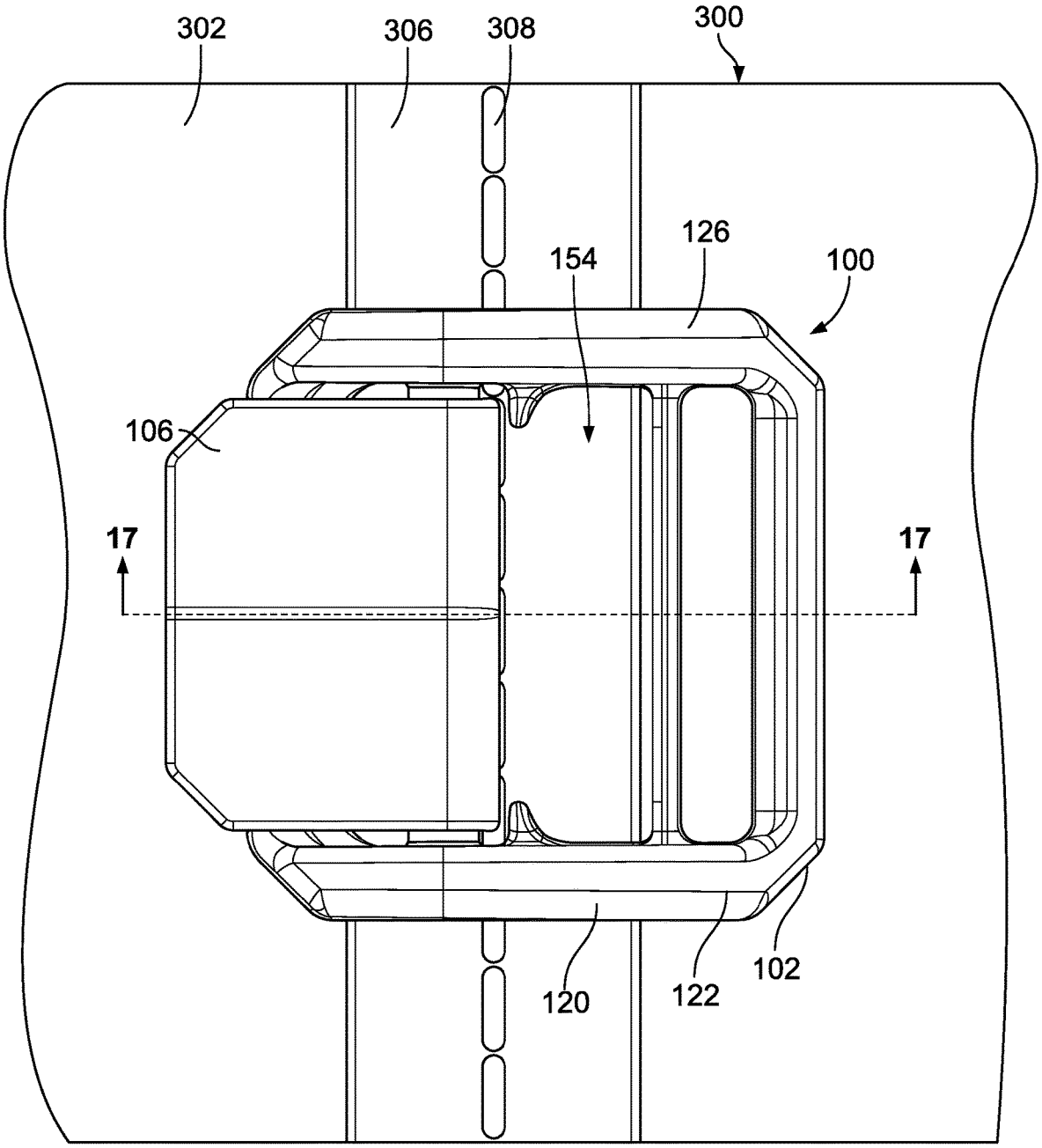
FIG. 16 is a partial top view of the locking slide clip of FIGS. 1-7 in the closed state of FIGS. 4-7 as assembled with the article of FIGS. 14 and 15.

With reference to FIGS. 16 and 17, when the locking slide clip 100 is installed on the article 300 and the door 106 is in the locked position 112, the locking slide clip 100 is locked onto the webbing rail 306. Referring specifically to FIG. 17, when the locking slide clip 100 is installed on the article 300 and the door 106 is in the locked position 112, the webbing rail 306 is compressed (e.g., pinched, crushed, squeezed, etc.) between the door 106 and the first and second legs 136, 138. Referring specifically, to FIG. 17, the webbing rail 306 is compressed between the first protrusion 216 and the first and second legs 136, 138. The webbing rail 306 is further compressed between the second protrusion 218 and the first and second legs 136, 138. It should be understood that compression of the webbing rail 306 between the second protrusion 218 and the first and second legs 136, 138 is greater than between the first protrusion 216 and the first and second legs 136, 138.

In operation, to install the locking slide clip 100 on the article 300, the door 106 is placed in the unlocked position 110, as shown in FIGS. 14 and 15. Further in operation, the locking slide clip 100 is then slid over the webbing rail 306 to pass the webbing rail 306 through the first and second rail openings 172, 174 and to pass the stitching 308 through the stitching slot 170 as described above and shown in FIGS. 14 and 15. Additionally, referring still to FIGS. 14 and 15, in operation, the locking slide clip 100 is slid along the webbing rail 306 to any desired location. In other words, the locking slide clip 100 is infinitely adjustable along the webbing rail 306.

Continuing in operation, the door 106 is moved from the unlocked position of FIGS. 14 and 15 to the locked position 112 of FIGS. 16 and 17. As the door 106 moves (e.g., pivots, swings, rotates, etc.) from the unlocked position 110 toward the locked position 112, first protrusion 216 moves through the door cavity 154 and the second protrusion 218 moves through the cam channel 178 to engage the webbing rail 306. As the door 106 continues to move toward the locked position 112, the first protrusion 216 also engages the webbing rail 306. When the door 106 reaches the locked position 112, the webbing rail 306 is tightly compressed between the first and second legs 136, 138 and the first and second protrusions 216, 218. In other words, in operation, the first and second protrusions 216, 218 act as a cam to tightly push the webbing rail 306 against the first and second legs 136, 138.

Further in operation, the door 106 may be moved from the locked position 112 of FIGS. 16 and 17 to the unlocked position of FIGS. 14 and 15 to release the webbing rail 306 from compression between the door 106 and the first and second legs 136, 138. Thus, the locking slide clip 100 may be readjusted along the webbing rail 306.

From the foregoing, it will be appreciated that the above disclosed locking slide clip 100 obviates the need to equip articles with textile rails that include stiff piping and may thus aid in reducing manufacturing complexity and associated costs. Further, the disclosed locking slide clip 100 may be more comfortable, more reliable, and simpler for individuals to use.

While various spatial and directional terms, such as top, bottom, lower, mid, lateral, horizontal, vertical, front and the like may be used to describe examples of the present disclosure, it is understood that such terms are merely used with respect to the orientations shown in the drawings. The orientations may be inverted, rotated, or otherwise changed, such that an upper portion is a lower portion, and vice versa, horizontal becomes vertical, and the like.

Variations and modifications of the foregoing are within the scope of the present disclosure. It is understood that the examples disclosed and defined herein extend to all alternative combinations of two or more of the individual features mentioned or evident from the text and/or drawings. All of these different combinations constitute various alternative aspects of the present disclosure. The examples described herein explain the best modes known for practicing the disclosure and will enable others skilled in the art to utilize the disclosure. The claims are to be construed to include alternative examples to the extent permitted by the prior art.

What is claimed is:

1. A locking slide clip, comprising:

a C-shaped body including a first leg, an upper portion connected to the first leg, and a second leg connected to the upper portion, the first leg and the second leg extending toward one another, the C-shaped body defining an opening and an open-ended slot in communication with the opening; and a door pivotably engaged with the C-shaped body opposite the open-ended slot and comprising a protrusion, wherein the upper portion comprises a first wall, a second wall, a third wall, and a fourth wall, wherein the second wall is connected and generally perpendicular to the first wall, the third wall is connected and generally perpendicular to the second wall and the fourth wall, and the fourth wall is opposite the second wall;

wherein the first and second legs extend below the upper portion;

wherein the second wall is connected to the first leg;

wherein the fourth wall is connected to the second leg; and wherein the first and second legs extend toward one another.

2. The locking slide clip of claim 1, wherein the protrusion faces the open-ended slot when the door is in a closed position relative to the C-shaped body.

3. The locking slide clip of claim 1, wherein:
the protrusion is a first protrusion, the door includes a second protrusion, and
the second protrusion extends from the first protrusion.

4. The locking slide clip of claim 1, wherein:
the door includes a hinge portion,
the hinge portion defines a first well and a second well, and
the first well and the second well are respectively configured to receive first and second hinge posts of the body.

5. The locking slide clip of claim 1, wherein:
the upper portion, the first leg, and the second leg define the opening; and
the first leg and the second leg define the open-ended slot.

6. The locking slide clip of claim 5, wherein:
the upper portion comprises a first hinge post and a second hinge post, and
the door is pivotably engaged with the first and second hinge posts.

7. The locking slide clip of claim 5, wherein:
the upper portion comprises a first stop tab and a second stop tab, and
the first and second stop tabs provide a stop to the door when the door is in an open position relative to the C-shaped body.

8. The locking slide clip of claim 1, wherein:
the opening is a first opening,
the upper portion comprises a fifth wall,
the fifth wall extends between the first and second walls,
the fourth wall is between the third and fifth walls, and
the first, second, fourth and fifth walls define a second opening.

9. The locking slide clip of claim 1, wherein the third wall provides a stop to the door when the door is in a closed position relative to the C-shaped body.

10. The locking slide clip of claim 1, wherein:
the door includes a locking portion and a handle portion,
the handle portion extends from the locking portion, and
the locking portion includes the protrusion.

11. The locking slide clip of claim 10, wherein:
the door includes a curved transition portion, and
the handle portion is connected to the locking portion via the curved transition portion.

12. The locking slide clip of claim 1, wherein:
the C-shaped body defines a cam channel, and
the protrusion is disposed in the cam channel.

13. The locking slide clip of claim 12, wherein the protrusion moves through the cam channel as the door pivots relative to the C-shaped body.

14. A locking slide clip, comprising:
a body comprising:
an upper portion,
a first leg extending below the upper portion, and
a second leg extending below the upper portion, wherein
the first leg and the second leg extend toward one another,
the first leg and the second leg define an open-ended slot,
the first leg, the second leg, and the upper portion define an opening in communication with the open-ended slot; and
a door pivotably engaged with the upper portion and comprising a protrusion,
wherein the first leg extends a first length within a plane and the open-ended slot defines a first width within the plane, and
wherein the first width is less than the first length.

15. The locking slide clip of claim 14, wherein:
the upper portion and the first leg define a cam channel, and
the protrusion is disposed in the cam channel.

16. The locking slide clip of claim 14, wherein:
the protrusion is a first protrusion, and
the door includes a second protrusion extending from and stepped relative to the first protrusion.

17. A locking slide clip, comprising:
a body having a first leg, an upper portion connected to the first leg, and a second leg connected to the upper portion, the first leg and the second leg extending toward one another, the body defining a door cavity, a cam channel, and a stitching slot, the stitching slot being open-ended and transverse to the cam channel; and
a door pivotably engaged with the body and comprising
a first protrusion at least partially disposed in the door cavity, and
a second protrusion extending from the first protrusion and at least partially disposed in the cam channel,
wherein the first leg extends a first length within a plane and the stitching slot defines a first width within the plane, and
wherein the first width is less than the first length.

18. The locking slide clip of claim 17, wherein, when the door pivots relative to the body,
the first protrusion moves through the door cavity, and
the second protrusion moves through the cam channel.

* * * * *